US007014048B2

(12) United States Patent
Anglerot et al.

(10) Patent No.: US 7,014,048 B2
(45) Date of Patent: Mar. 21, 2006

(54) COMPOSITION FORMED OF MERCAPTANS WHICH CAN BE USED IN A PROCESS FOR THE FLOTATION OF ORES

(75) Inventors: Didier Anglerot, Lons (FR); Annie Commarieu, Pau (FR); Thierry Aubert, Pau (FR)

(73) Assignee: Arkema, Puteaux (FR)

( * ) Notice: Subject to any disclaimer, the term of this patent is extended or adjusted under 35 U.S.C. 154(b) by 49 days.

(21) Appl. No.: 10/863,935

(22) Filed: Jun. 9, 2004

(65) Prior Publication Data

US 2005/0167339 A1 Aug. 4, 2005

(30) Foreign Application Priority Data

Jun. 16, 2003 (FR) ..... 03.07180
Apr. 8, 2004 (FR) ..... 04.03696

(51) Int. Cl.
*B03D 1/012* (2006.01)
*B03D 1/02* (2006.01)

(52) U.S. Cl. ..... 209/166; 252/61

(58) Field of Classification Search ..... 209/166, 209/167; 252/61
See application file for complete search history.

(56) References Cited

U.S. PATENT DOCUMENTS 4,211,644 A 7/1980 Wiechers
4,416,770 A * 11/1983 Bresson et al. ..... 209/167
4,424,122 A * 1/1984 Parlman et al. ..... 209/166
4,439,314 A 3/1984 Parlman et al.
4,526,696 A 7/1985 Delourme et al.
4,594,151 A * 6/1986 Delourme et al. ..... 209/166
4,595,893 A 6/1986 Charbonnier et al.

FOREIGN PATENT DOCUMENTS

EP 0038076 10/1981
EP 1504820 A1 * 2/2005
FR 1011166 12/1948
FR 2371967 6/1978
WO WO 0009268 2/2000

* cited by examiner

*Primary Examiner*—Thomas M. Lithgow
(74) *Attorney, Agent, or Firm*—Steven D. Boyd

(57) ABSTRACT

Composition intended for the flotation of ores, comprising:

from 70 to 95% of a combination (A) of n-dodecyl mercaptan (or NDM) and of tert-dodecyl mercaptan (or TDM), the NDM/TDM ratio by weight of which is between 0.5 and 1.5, and from 5 to 30% of a product (B) composed of one or more aromatic or aliphatic compounds comprising from 4 to 100 carbon atoms, preferably from 5 to 40, and having one or two —OH groups.

Process for the recovery by flotation of metal compounds of value present in ores employing it.

13 Claims, No Drawings

COMPOSITION FORMED OF MERCAPTANS WHICH CAN BE USED IN A PROCESS FOR THE FLOTATION OF ORES

FIELD OF THE INVENTION

The present invention relates to the field of the extraction of metals and more especially the flotation of ores, in particular ores based on oxides and on sulphides. It relates more particularly to a novel composition based on mercaptans which can be used, in particular, in combination with a flotation agent, and to a process for the recovery, by flotation, of metal compounds of value.

BACKGROUND

Flotation is a well known process having the aim of extracting a metal from low-content ores by a stage of concentration. This stage comes before a subsequent treatment comprising the heat treatment (also known as smelting) or the leaching and the refining. This is in particular the case with ores of oxides and/or of sulphides of lead, of zinc, of copper, of silver, of gold, of molybdenum and of metals belonging to the platinum group: platinum, palladium, rhodium, ruthenium, iridium and osmium.

The ores include the compounds (such as oxides or sulphides) of the metals to be extracted (or metal compounds of value) in the form of crystals which are dispersed in a gangue composed of various impurities, in particular siliceous impurities. The ores are therefore, after extraction from the mine, crushed and then milled in a wet medium to give particles which are sufficiently fine to release the crystals of the desired compounds.

During flotation, the highly heterogeneous mixture, on the one hand of the crystals of the desired compounds and, on the other hand, of the gangue particles, is therefore introduced into water comprising appropriate additives, in particular flotation agents, also known as flotation collectors. Air is injected into the aqueous suspension thus obtained, placed in a suitable device (generally a flotation cell), so as to create bubbles which adhere to the crystals of the compounds (such as oxides and/or sulphides) comprising the desired metal. The adhesion of the bubbles to the said crystals is promoted by the action of the flotation agent or agents used. The crystals of the metal compounds then rise to the surface and are recovered in the form of a foam, also known as flotation concentrate. The gangue particles are recovered in the lower part of the flotation cell.

The flotation concentrate has a content of desired metal which is therefore considerably higher than that in the starting ore. This content depends on the initial content in the ore and on the selectivity of the flotation process. The amount of metal recovered in the form of flotation concentrate for its part depends on the yield of the process.

Flotation agents commonly employed in the industry for the extraction of metals include, for example, alkali metal xanthates with alkyl radicals having less than 6 carbon atoms, in particular potassium ethyl, amyl or isobutyl xanthate, mercapto-benzothiazoles, thiocarbamates, dithiocarbamates and dithiophosphates.

After a stage of drying by filtration, the flotation concentrates, for example in the case of copper, are subsequently introduced, for the heat treatment (or smelting) stage, into a furnace at temperatures which may exceed 1500° C. During this stage, the desired metal is separated in the molten state from the other substances, in particular from the impurities originating from the gangue of the ore, which have to be removed in the form of a slag.

It is thus understood, in particular for this reason, that it is very important on a practical level to obtain, on conclusion of the flotation stage, in addition to a high yield, a concentrate which has a content of the desired metal which is as high as possible, so as to facilitate the subsequent operations of treatment of the said concentrate and of final isolation of the metal. This technical advantage for flotation concentrates with a high content of desired metal is also reflected by the enhancement in value and the cost of such concentrates, sold by mining companies to companies in charge of the recovery of the metal and of its purification (or refining). This aspect of the metal content of the concentrate resulting from flotation is particularly critical in the case of platinum, the content of which in ores is extremely low and usually of the order of 2 to 15 ppm.

The use of mercaptans as flotation agent is already known.

U.S. Pat. No. 4,211,644 thus discloses the use, in the production of flotation concentrates, of a solution of n-dodecyl mercaptan in a polyglycol. However, this document teaches such a use in the production of flotation concentrates with an increased content of copper.

South African Patent ZA 8405787 discloses the use, as flotation collector, of a solution of tert-dodecyl mercaptan in cresylic acid. This document also discloses the application of such collectors in the treatment of copper ores.

In point of fact, the industry for the extraction of platinum, and more especially for the concentration of platinum ores by flotation, is, for the reasons indicated above, always looking for novel means which make it possible to improve the content of platinum in the flotation concentrates (or selectivity) and the yield of the flotation.

DETAILED DESCRIPTION

The aim of the invention is to provide such a means, the description of which is given in the continuation of the present text. In what follows, the percentages which are indicated are, in the absence of contrary indications, percentages corresponding to contents by weight.

A first subject-matter of the present invention is thus a composition intended for the flotation of ores, comprising:

- from 70 to 95% of a combination (A) of n-dodecyl mercaptan (or NDM) and of tert-dodecyl mercaptan (or TDM), the NDM/TDM ratio by weight of which is between 0.5 and 1.5, and
- from 5 to 30% of a product (B) composed of one or more aromatic or aliphatic compounds comprising from 4 to 100 carbon atoms, preferably from 5 to 40, and having one or two —OH groups.

This is because it has been found that this specific composition makes it possible to significantly improve the content of platinum in the filtration concentrates which are obtained from the ores by the use of conventional collecting agents and possibly the yield of the flotation operation.

n-Dodecyl mercaptan is the thiol derivative of the alkyl radical comprising a linear chain having 12 carbon atoms of formula n-$C_{12}H_{25}$—SH. This is a commercially available product.

tert-Dodecyl mercaptan is understood to mean a mixture of compounds of formula:

$$R—SH \quad (I)$$

in which R is an alkyl radical having between 9 and 15 carbon atoms and having at least one tertiary carbon which is connected to the SH group.

The mean number of carbon atoms in the alkyl radical is 12. The content in the mixture of the compound of formula (I) in which R is a dodecyl radical is greater than 50%, preferably greater than or equal to 60%, by weight. Such a mixture is also available commercially and can be prepared by the process disclosed in U.S. Pat. No. 4,565,893.

Without being commited in any way with regard to the exact role of the product (B) in the composition according to the invention, it appears that the product (B) acts as dispersing and/or foaming agent.

According to a first preferred alternative form, the product (B) is chosen from the group consisting of phenols optionally substituted by one or more $C_1$-$C_4$ alkyl radicals, cresols, naphthols, xylenols, indanols and mixtures of these compounds. The said mixtures, in which the compounds are generally present in the form of their various isomers, are denoted in the present text under the term of "cresylic acid".

According to another preferred alternative form, the product (B) is chosen from the group consisting of:

a propylene oxide oligomer with a molecular mass of between 50 and 2000, preferably between 100 and 800; and 2-methyl-4-pentanol, a compound also known as Methyl IsoButyl Carbinol or MIBC, of formula:

$$CH_3—CH(OH)—CH_2—CH(CH_3)—CH_3$$

The composition according to the invention advantageously comprises from 75 to 85% of the combination (A) of NDM and TDM and from 15 to 25% of the product (B).

According to a preferred alternative form, taken in combination with one of the preceding alternative forms, cresylic acid is used as product (B). According to another preferred alternative form, use is made, as product (B), of MIBC or a propylene oxide oligomer with a molecular mass of between 50 and 2000, preferably between 100 and 800.

According to yet another preferred alternative form, the composition according to the invention is a solution.

A composition according to the invention in which the NDM/TDM ratio is in the region of 1 is particularly advantageous.

Another subject-matter of the present invention is a process for the recovery by flotation of metal compounds of value present in ores comprising the introduction into an appropriate cell of at least one flotation collector, characterized in that it additionally comprises the introduction into the said cell of an effective amount of the composition as defined above.

It is preferable to use, as flotation collector (or agent), a compound chosen from alkali metal xanthates with alkyl radicals having less than 6 carbon atoms and mercaptobenzothiazoles and from thiocarbamates, dithiocarbamates and alkali metal dithiophosphates.

A particularly advantageous flotation collector is an alkali metal xanthate of an alkyl radical having less than 6 carbon atoms or an alkali metal dithiophosphate.

It is preferable to use, as flotation agent, potassium or sodium ethyl, amyl or isobutyl xanthate.

In the process according to the invention, the amount of composition based on NDM and TDM as defined above to be introduced into the process can be easily determined by a person skilled in the art from preliminary tests according to various parameters, such as the content of desired metal in the ore. This amount generally corresponds to a ratio by weight, expressed on the basis of the weight of ore treated, of between 2 g/tonne and 150 g/tonne, preferably between 5 and 50 g/tonne. The ratio of the weight of the composition according to the invention to the total weight of flotation agent can vary within very wide limits, for example between 0.5 and 200%, preferably between 15 and 125%.

The process according to the invention may be suitable for the recovery of metal compounds, such as oxides and/or sulphides, comprising one or more metals chosen from the group consisting of: lead, zinc, copper, molybdenum, nickel, cobalt, palladium, osmium, ruthenium, rhodium, iridium and platinum. The said process may also be suitable for the recovery of the said metals in the native state.

However, it is preferable to employ it in the recovery of platinum compounds.

The introduction of the composition according to the invention and of the flotation collector or collectors can be simultaneous or sequential. Generally, a sequential introduction of the flotation collector or collectors, followed by that of the composition based on NDM and TDM according to the invention, is preferred.

Finally, the composition according to the invention can be introduced both in the stage of a primary flotation and in the stage of a secondary flotation (carried out on the sterile fraction corresponding to the particles separated by settling in the lower part of the cell during the primary flotation).

The invention is illustrated by the following examples, which are in no way limiting.

EXAMPLES

Example 1 (Reference)

Flotation of platinum ore with a xanthate and the dithiophosphate as flotation agents:

This flotation test is carried out on a sulphide-comprising platinum ore of UG2 type originating from a South African mine in the Rustenburg region, having a platinum content of 2.5 ppm.

Stage 1: Preparation of an Aqueous Suspension of the ore by Milling and Sieving 1150 g of this ore are mixed with 572 g of water and introduced into a ball mill. The ore is thus milled for 30 minutes. The suspension is sieved through a sieve with a mesh of 0.1 mm and an aqueous suspension A comprising 933 g of dry ore, the particles of which have a mean diameter (measured by laser particle size determination) of 40 $\mu$m, is thus recovered.

Stage 2: Introduction of the Flotation Additives into the Aqueous Suspension of the ore 4.5 ml of a 10.3 g/l copper sulphate solution are added to the suspension A as depressor (promoting the fall of the gangue particles in the lower part of the flotation cell).

Approximately 2 minutes later, 79.3 mg of sodium isobutyl xanthate and 42 mg of thiophosphate are added, these 2 products being in the form of an aqueous solution.

Approximately 4 minutes later, 56 mg of cresylic acid, sold by Rütgers-Huiles Goudrons et Dérivés, are added.

The amount of water necessary to have a total volume of 2.5 l is added.

Stage 3: Primary Flotation

After standing for approximately 1 minute, the mixture obtained in Stage 2 is subjected to flotation for 5 minutes at a pH in the region of 8 in a 2.5 litre laboratory cell of the Wemco type.

73 g of concentrate are collected by skimming off at the surface of the flotation cell.

This concentrate has a platinum content of 18 ppm (corresponding to the selectivity) and includes 51.2% of the Pt present in the ore treated (the latter percentage corresponding to the yield).

Stage 4: Secondary Flotation

The sterile fraction corresponding to the particles separated by settling in the lower part of the flotation cell is recovered and is treated with 13 mg of sodium isobutyl xanthate and 9.7 mg of sodium dithiophosphate.

After mixing for 4 minutes, 5.6 mg of cresylic acid are added and the volume of water is adjusted to 2.5 l.

The product obtained is subjected to flotation for 3 minutes under the same conditions as in Stage 3.

26.5 g of flotation concentrate having a platinum content of 6.6 ppm, corresponding to a Pt yield of 6.8%, are recovered.

The total degree of recovery of the platinum (or total yield) is therefore 58%.

Example 2

The following solution is prepared by simple mixing:

| | |
|---|---|
| NDM | 40% |
| TDM | 40% |
| Cresylic acid | 20% |

The NDM and the TDM used are the products sold by Atofina.
The cresylic acid used also originates from Rütgers-Huiles Goudrons et Dérivés.

Example 3

Reference Example 1 is repeated while introducing, in Stage 2, in addition to the flotation agents, 28 mg of the solution prepared in accordance with Example 2.

After the primary flotation of Stage 3, 67 g of concentrate having a platinum content of 26.6 ppm, corresponding to a yield of 66.4%, are collected.

The secondary flotation of Stage 4 of reference Example 1 is also repeated while adding 28 mg of the solution of Example 2.5 g of flotation concentrate having a platinum content of 10 ppm, corresponding to a yield of 1.9%, are recovered.

The total yield is therefore 68.3%.

Example 4 (Reference)

Flotation of platinum ore with a xanthate and the dithiophosphate as flotation agent:

This flotation test is carried out on a sulphide-comprising platinum ore of UG2 type originating from a South African mine in the Rustenburg region, having a platinum content of 2 ppm.

Stage 1: Preparation of an Aqueous Suspension of the ore by Milling and Sieving 1000 g of this ore are mixed with 508 g of water and introduced into a ball mill. The ore is thus milled for 50 minutes. The suspension is sieved through a sieve with a mesh of 0.1 mm, 20 to 30 g of ore are withdrawn for analysis and an aqueous suspension A comprising approximately 945 g of dry ore, the particles of which have a mean diameter (measured by laser particle size determination) of approximately 30 $\mu$m, is thus recovered.

Stage 2: Introduction of the Flotation Additives into the Aqueous Suspension of the ore 50 grams (expressed as equivalent per tonne of milled ore) of copper sulphate in aqueous solution are added to the suspension A in the flotation cell, stirred at 1200 rpm, as depressor (promoting the fall of the gangue particles in the lower part of the flotation cell).

Approximately 2 minutes later, 85 grams (per tonne of milled ore) of sodium isobutyl xanthate and 45 grams (per tonne of milled ore) of sodium dithiophosphate are added, these two products being in the form of an aqueous solution.

Approximately 4 minutes later, 60 grams (per tonne of milled ore) of a cresylic acid, comprising approximately 25% of a mixture of meta- and para-cresol, 27% of a mixture of 2,4-xylenol and 2,5-xylenol, and approximately 30% of a mixture of methyl(ethyl)phenol and propyl(ethyl)phenol, are added. Such a cresylic acid is sold by Merisol.

The amount of water necessary to have a total volume of 2.5 l is added.

Stage 3: Primary Flotation

After bringing the ingredients into contact for approximately 1 minute, the mixture obtained in Stage 2 is subjected to flotation for 5 minutes at a pH in the region of 8 in a 2.5 litre laboratory cell of the Wemco type. The volume of the solution is maintained at 2.5 litres by addition of water throughout the duration of the flotation.

The weight of concentrate collected by skimming off at the surface of the flotation cell is 124 g. The platinum content of the said concentrate (corresponding to the selectivity) is 12.2 ppm and the amount of platinum recovered (expressed as percentage of that present in the ore treated, corresponding to the yield) is 80%.

Example 5

Example 2 is repeated while using, as cresylic acid, that employed in Stage 2 of Example 4.

Example 6

The reference Example 4 is repeated while introducing, in Stage 2, in addition to the flotation agents, 30 grams (per tonne of ore) of the solution prepared in accordance with Example 5.

The weight of concentrate collected is 88.7 g, for a selectivity of 14 ppm and a yield of 65.9%.

Example 7

Example 2 is repeated while replacing the cresylic acid by a propylene oxide oligomer with an average molecular mass of 425 sold by Bayer under the name Arco® PPG-425.

Example 8

Reference Example 4 is repeated while introducing, in Stage 2, in addition to the flotation agents, 30 grams (per tonne of ore) of the solution prepared in accordance with Example 7.

The weight of concentrate collected is 115.6 g, for a selectivity of 12.6 ppm and a yield of 76.4%.

Example 9

Example 2 is repeated while replacing the cresylic acid by MIBC.

Example 10

Reference Example 4 is repeated while introducing, in Stage 2, in addition to the flotation agents, 30 grams (per tonne of ore) of the solution prepared in accordance with Example 9.

The weight of concentrate collected is 104.8 g, for a selectivity of 12.8 ppm and a yield of 70.5%.

These examples show that the addition of the composition according to the invention to the flotation collectors conventionally used for the concentration of platinum significantly increases the content of platinum in the flotation concentrate and/or the yield.

The invention claimed is:

1. Composition intended for the floatation or ores, comprising:

(A) from 70 to 95% of a combination of n-dodecyl mercaptan and tert-dodecyl mercaptan, wherein the ratio by weight of n-dodecyl mercaptan to tert-dodecyl mercaptan is between about 0.5 and about 1.5, and (B) from about 5–30% of one or more aromatic or aliphatic compounds comprising from 4 to 100 carbon atoms, and having one or two —OH groups.

2. Composition according to claim 1, characterized in that (B) is chosen from the group consisting of phenols, phenols substituted by one or more $C_1$-$C_4$ alkyl radicals, cresols, naphthols, xylenols, indanols and mixtures of these compounds.

3. Composition according to claim 1, characterized in that (B) is selected from the group consisting of: a propylene oxide oligomer with a molecular mass of between about 50 and about 2000, and 2-methyl-4-pentanol.

4. Composition according to claim 1, comprising from about 75 to about 85% of (A) and from about 15 to about 25% of (B).

5. Composition according to claim 1, wherein (B) is cresylic acid.

6. Composition according to claim 1 wherein, (B) is selected from the group consisting of 2-methyl-4-pentanol or a propylene oxide oligomer with a molecular mass of between about 50 and about 2000.

7. Composition according to claim 1, characterized in that it is a solution.

8. Composition according to claim 1, characterized in that the ratio of n-dodecyl mercaptan to tert-dodecyl mercaptan is about 1.

9. Process for the recovery by floatation of metal compounds of value present in ores, comprising the introduction into an appropriate cell of at least one floatation agent, wherein the improvement comprises the introduction into the said cell of an effective amount of the composition as defined in claim 1.

10. Process according to claim 9, characterized in that the floatation agent is an alkali metal xanthate of an alkyl radical having less than 6 carbon atoms or an alkali metal dithiophosphate.

11. Process according to of claim 9, characterized in that the metal compounds of value present in the ores comprise-platinum compounds.

12. Composition according to claim 3, wherein the molecular mass of said propylene oxide oligomoer is between about 100 and about 800.

13. Composition according to claim 6 wherein the molecular mass of said propylene oxide oligomoer is between about 100 and about 800.

* * * * *